US010597213B2

(12) United States Patent
Usami et al.

(10) Patent No.: US 10,597,213 B2
(45) Date of Patent: Mar. 24, 2020

(54) PRESSURE REDUCTION-ABSORBING BOTTLE

(71) Applicant: YOSHINO KOGYOSHO CO., LTD., Tokyo (JP)

(72) Inventors: Tetsuro Usami, Tokyo (JP); Seiichi Asaoka, Matsudo (JP); Takahiro Haruna, Matsudo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 25 days.

(21) Appl. No.: 15/935,503

(22) Filed: Mar. 26, 2018

(65) Prior Publication Data

US 2018/0273271 A1 Sep. 27, 2018

(30) Foreign Application Priority Data

Mar. 27, 2017 (JP) ..... 2017-060398
Mar. 27, 2017 (JP) ..... 2017-060399

(51) Int. Cl.
*B65D 79/00* (2006.01)
*B65D 1/02* (2006.01)

(52) U.S. Cl.
CPC ..... *B65D 79/005* (2013.01); *B65D 1/0261* (2013.01); *B65D 2501/0036* (2013.01)

(58) Field of Classification Search
CPC ..... B65D 1/0261; B65D 2501/0036; B65D 79/005; B65D 1/0284; B65D 1/0207
USPC ..... 215/375, 371
See application file for complete search history.

(56) References Cited

U.S. PATENT DOCUMENTS 5,713,480 A * 2/1998 Petre ..... B65D 1/0284 215/373
6,176,382 B1 * 1/2001 Bazlur Rashid ..... B65D 1/0276 215/373
6,942,116 B2 * 9/2005 Lisch ..... B65D 79/005 215/371
7,150,372 B2 * 12/2006 Lisch ..... B65D 1/0276 215/373
7,451,886 B2 * 11/2008 Lisch ..... B65D 1/0276 215/371
8,998,026 B2 * 4/2015 Nakayama ..... B65D 1/40 220/609
9,296,539 B2 * 3/2016 Wright ..... B65D 1/0276
9,650,207 B2 * 5/2017 Nakayama ..... B65D 1/0284
(Continued)

FOREIGN PATENT DOCUMENTS

JP 2013-023278 A 2/2013

*Primary Examiner* — Ernesto A Grano
(74) *Attorney, Agent, or Firm* — Oliff PLC

(57) ABSTRACT

The present invention is a pressure reduction-absorbing bottle having a cylindrical shape with a bottom made of a synthetic resin material in which a bottom wall portion of a bottom portion of the bottle includes a grounding portion, a rising circumferential wall portion, a movable wall portion, and a central wall portion, the movable wall portion includes a curved portion having a curved surface shape protruding downward, the curved portion is connected to an outer end portion of the central wall portion in a bottle radial direction, and a lowest portion of the curved portion positioned at a lowest position thereof is located at a portion of the curved portion further outward in the bottle radial direction than a central position of the curved portion in the bottle radial direction.

7 Claims, 8 Drawing Sheets

(56) References Cited

U.S. PATENT DOCUMENTS

| | | | | |
|---|---|---|---|---|
| 10,214,313 | B2 * | 2/2019 | Oshino | B65D 1/0223 |
| 2002/0074336 | A1 * | 6/2002 | Silvers | B65D 1/0276<br>220/623 |
| 2007/0084821 | A1 * | 4/2007 | Bysick | B65D 1/0276<br>215/373 |
| 2009/0159556 | A1 * | 6/2009 | Patcheak | B65D 1/0276<br>215/373 |
| 2009/0242575 | A1 * | 10/2009 | Kamineni | B65D 1/0276<br>220/608 |
| 2009/0308835 | A1 * | 12/2009 | Boukobza | B65D 1/0284<br>215/370 |
| 2010/0140278 | A1 * | 6/2010 | Kelley | B65D 1/0276<br>220/628 |
| 2013/0213926 | A1 * | 8/2013 | Kurihara | B65D 1/0276<br>215/371 |
| 2014/0227399 | A1 * | 8/2014 | Wortmann | B65D 1/0284<br>426/106 |
| 2015/0298848 | A1 * | 10/2015 | Hermel | B65D 1/0284<br>215/373 |

* cited by examiner

PRESSURE REDUCTION-ABSORBING BOTTLE

BACKGROUND

Field of the Invention

The present invention relates to a pressure reduction-absorbing bottle. Priority is claimed on Japanese Patent Application Nos. 2017-060399 and 2017-060398, filed Mar. 27, 2017, the content of which is incorporated herein by reference.

Description of Related Art

In recent years, as a pressure reduction-absorbing bottle made of a synthetic resin material in a cylindrical shape with a bottom, for example, as shown in Japanese Unexamined Patent Application, First Publication No. 2013-23278, a constitution in which a bottom wall portion of a bottom portion of a bottle includes a grounding portion at an outer circumferential edge, a rising circumferential wall portion connected to the grounding portion from an inner side of the bottle in a bottle radial direction and extending upward, an annular movable wall portion extending from an upper end portion of the rising circumferential wall portion toward an inner side of the bottle in the bottle radial direction, and a central wall portion connected to an inner end portion of the movable wall portion in the bottle radial direction, in which the movable wall portion is rotationally moved upward together with the central wall portion about a connection portion between the movable wall portion and the rising circumferential wall portion so that pressure reduction in the bottle is absorbed has become known. In order to secure a pressure-reduction absorbing capacity after filling of contents, this kind of pressure reduction-absorbing bottle is sealed in a state in which the bottom wall portion is deformed at the time of filling of the contents so that the central wall portion is displaced downward.

However, in the pressure reduction-absorbing bottle in the related art, the movable wall portion is less likely to be rotationally moved evenly upward over the entire circumference when a pressure in the bottle becomes negative after sealing is applied. In this case, the appearance of the pressure reduction-absorbing bottle is likely to deteriorate and a height position of a liquid surface is likely to be different for each of pressure reduction-absorbing bottles despite being filled with the same amount of contents.

Also, if this kind of pressure reduction-absorbing bottle is sealed in a state in which the bottom wall portion is deformed at the time of filling of the contents so that the movable wall portion is greatly displaced downward, a large pressure-reduction absorbing capacity can be secured. As means for increasing such a pressure-reduction absorbing capacity, a constitution in which the rising circumferential wall portion is greatly inclined inward in the bottle radial direction may be adopted and thus it is conceivable that it would be easy to displace downward the whole of the bottom wall portion further inward in the bottle radial direction than the grounding portion at the time of filling of contents.

However, in such a pressure reduction-absorbing bottle, the rising circumferential wall portion is rotationally moved downward about a connection portion between the rising circumferential wall portion and the grounding portion at the time of filling of contents. For this reason, for example, ground-contact stability is likely to deteriorate due to the occurrence of unnecessary deformation of the grounding portion such as large local deformation of part of the grounding portion.

Therefore, an object of the present invention is to provide a pressure reduction-absorbing bottle in which a movable wall portion can be rotationally moved evenly upward over the entire circumference when a pressure in the bottle becomes negative after sealing is applied and a pressure-reduction absorbing capacity can be increased without deteriorating ground-contact stability at the time of filling of contents.

SUMMARY

In order to accomplish the above object, the present invention adopts the following means. That is to say, a first aspect of the present invention is a pressure reduction-absorbing bottle having a cylindrical shape with a bottom and formed of a synthetic resin material. The bottle includes a bottom wall portion in a bottom portion of the bottle including: a grounding portion positioned at an outer circumferential edge of the bottom wall portion; a rising circumferential wall portion connected to the grounding portion from an inner side of the bottle in a bottle radial direction and extending upward; an annular movable wall portion extending from an upper end portion of the rising circumferential wall portion toward the inner side of the bottle in the bottle radial direction; and a central wall portion connected to an inner end portion of the movable wall portion in the bottle radial direction. In the bottle, the movable wall portion is arranged to be configured to be freely rotationally moved about a connection portion between the movable wall portion and the rising circumferential wall portion in a vertical direction together with the central wall portion and includes a curved portion having a curved surface shape protruding downward, the curved portion is connected to an outer end portion of the central wall portion in the bottle radial direction, and a lowest portion of the curved portion positioned at a lowest position thereof is at a portion of the curved portion positioned further outward in the bottle radial direction than a central position of the curved portion in the bottle radial direction.

In the first aspect of the present invention, in the curved portion connected to the outer end portion of the central wall portion in the bottle radial direction, the lowest portion of the curved portion is positioned at the portion of the curved portion positioned further outward in the bottle radial direction than the central position of the curved portion in the bottle radial direction. For this reason, a long distance in the bottle radial direction between the lowest portion and the outer end portion of the central wall portion in the bottle radial direction is secured. Therefore, in conjunction with an increase in curvature radius of the inner peripheral portion of the curved portion connected to the central wall portion, deformation of the lowest portion of the curved portion such that it points downward when the central wall portion is displaced downward associated with filling of contents can be minimized. For this reason, the movable wall portion can be rotationally moved evenly upward over the entire circumference thereof when a pressure in the bottle becomes negative after sealing is applied.

A second aspect of the present invention is the pressure reduction-absorbing bottle of the first aspect, in which the central wall portion extends upward from the inner end portion of the movable wall portion in the bottle radial direction. In this case, the central wall portion extends upward from the inner end portion of the movable wall portion in the bottle radial direction. For this reason, the inner end portion of the movable wall portion in the bottle radial direction is easily deformed when the central wall portion is displaced downward associated with filling of the contents. Therefore, the above-described effects can be effectively achieved.

A third aspect of the present invention is the pressure reduction-absorbing bottle of the first aspect or the second aspect, in which an outer end portion of the movable wall portion in the bottle radial direction is an inclined portion gradually extending upward as it goes from the upper end portion of the rising circumferential wall portion toward the inner side of the bottle in the bottle radial direction.

In the third aspect of the present invention, the outer end portion of the movable wall portion in the bottle radial direction is the inclined portion gradually extending upward as it goes from the upper end portion of the rising circumferential wall portion toward the inner side of the bottle in the bottle radial direction. For this reason, the movable wall portion is easily rotationally moved downward about the connection portion between the inclined portion and the upper end portion of the rising circumferential wall portion at the time of filling of contents. Therefore, an amount of displacement toward the side below the movable wall portion at the time of filling of the contents can be increased and a pressure-reduction absorbing capacity in a sealing state can be increased. Moreover, since the movable wall portion is rotationally moved downward about the connection between the upper end portion of the rising circumferential wall portion and the inclined portion which is spaced apart upward from the grounding portion at the time of filling of the contents, deformation of the grounding portion when the movable wall portion is displaced downward can be prevented. As described above, the pressure-reduction absorbing capacity can be increased without decreasing ground-contact stability.

A fourth aspect of the present invention is the pressure reduction-absorbing bottle of the third aspect, in which in a vertical cross-sectional view in a bottle axial direction, a curvature radius of a connection portion between the inclined portion and the upper end portion of the rising circumferential wall portion is greater than a curvature radius of a connection portion of the movable wall portion between the inclined portion and a curved portion connected to the inclined portion from an inner side of the inclined portion in the bottle radial direction In this case, in the vertical cross-sectional view in the bottle axial direction, the curvature radius of the connection portion between the inclined portion and the upper end portion of the rising circumferential wall portion is greater than the curvature radius of the connection portion between the curved portion and the inclined portion. For this reason, the movable wall portion can be easily rotationally moved downward about the connection portion between the inclined portion and the upper end portion of the rising circumferential wall portion at the time of filling of contents.

A fifth aspect of the present invention is the pressure reduction-absorbing bottle of the third aspect or the fourth aspect, in which in the vertical cross-sectional view in the bottle axial direction, a length of the curved portion in the movable wall portion connected to the inclined portion from the inner side of the inclined portion in the bottle radial direction and connected to the central wall portion from an outer side of the central wall portion in the bottle radial direction is greater than a length of the inclined portion.

In this case, in the vertical cross-sectional view in the bottle axial direction, the length of the curved portion is longer than the length of the inclined portion. For this reason, the movable wall portion can be rotationally moved downward about the connection portion between the inclined portion and the upper end portion of the rising circumferential wall portion while deformation of the inclined portion is minimized at the time of filling of the contents. Therefore, an amount of displacement toward the side below the movable wall portion at the time of filling of contents can be effectively increased.

According to the present invention, a movable wall portion can be rotationally moved evenly upward over the entire circumference when a pressure in the bottle becomes negative after sealing is applied and a pressure-reduction absorbing capacity can be increased without deteriorating ground-contact stability at the time of filling of contents.

DETAILED DESCRIPTION (An Embodiment)

Figure 1:
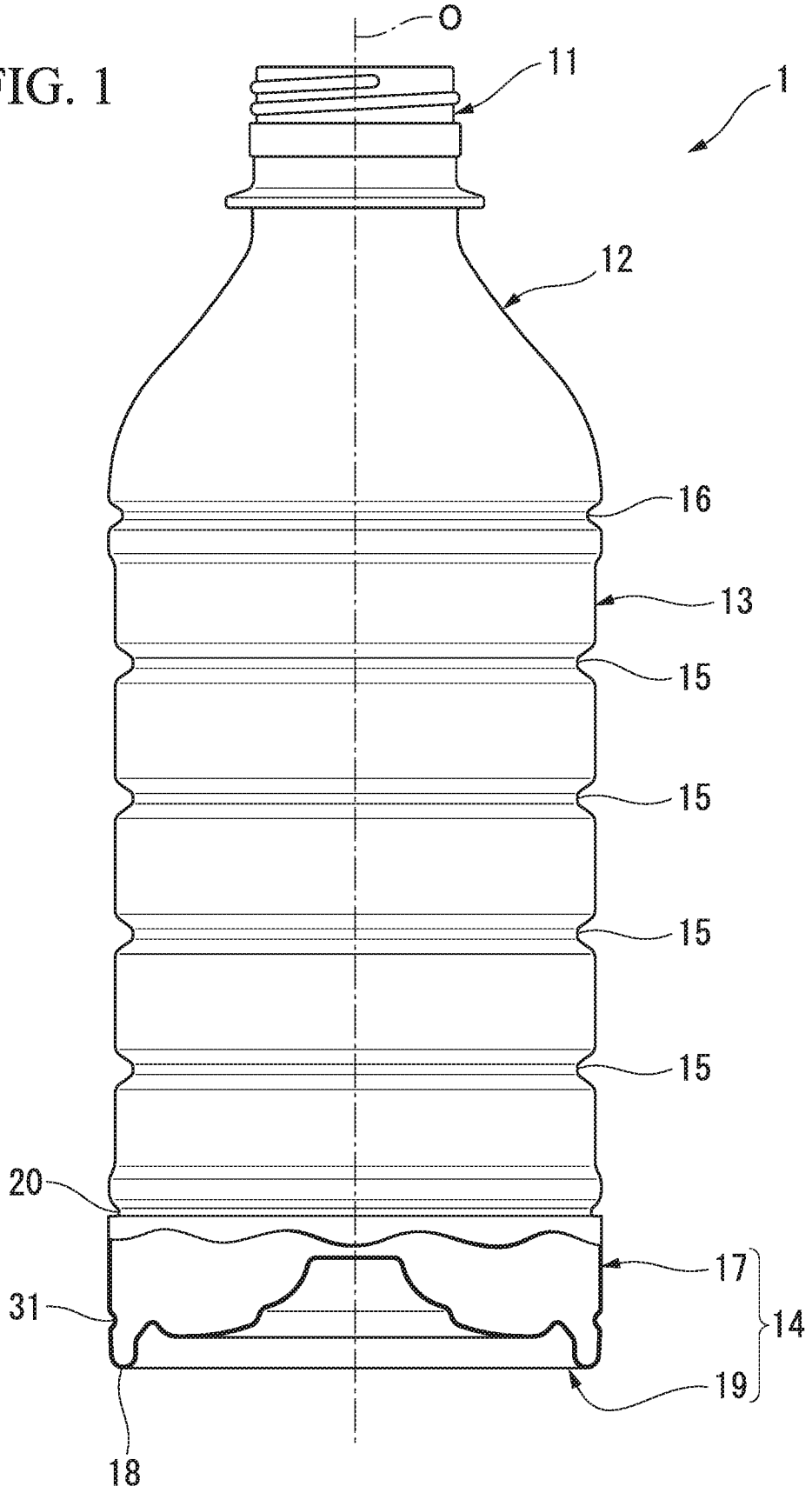
FIG. 1 is a partial cross-sectional view of a pressure reduction-absorbing bottle shown in an embodiment according to the present invention.

A pressure reduction-absorbing bottle according to a first embodiment of the present invention will be described below with reference to the drawings. As shown in FIG. 1, a pressure reduction-absorbing bottle 1 according to the embodiment includes a mouth portion 11, a shoulder 12, a body 13, and a bottom portion 14 of the bottle and has a schematic constitution in which the mouth portion 11, the shoulder 12, the body 13, and the bottom portion 14 of the bottle are connected consecutively in this order in a state in which their central axis lines are on a common axis.

Hereinafter, the above-described common axis is referred to as a bottle axis O, the mouth portion 11 side in a bottle axis O direction is referred to as an upper side, the bottom portion 14 side of the bottle is referred to as a lower side, a direction along the bottle axis O is referred to as a vertical direction, a direction orthogonal to the bottle axis O when viewed from the vertical direction is referred to as a bottle radial direction, and a direction around the bottle axis O is referred to as a bottle circumferential direction. Note that the pressure reduction-absorbing bottle 1 is formed by blow-molding a preform formed to have a cylindrical shape with a bottom through injection molding and integrally made of a synthetic resin material. A cap (not shown) is attached to the mouth portion 11. The shape of the mouth portion 11, the shoulder 12, the body 13, and the bottom portion 14 of the bottle in a horizontal cross-sectional view orthogonal to the bottle axis O is circular.

The body 13 is formed in a tubular shape and an intermediate portion between an upper end portion and a lower end portion is formed to have a diameter smaller than those of the upper end portion and the lower end portion. A first annular groove 16 extending continuously over the entire circumference is formed in a connection portion between the shoulder 12 and the body 13. A plurality of second annular grooves 15 extending continuously over the entire circumference are formed in the body 13 at intervals in the vertical direction. A third annular groove 20 extending continuously over the entire circumference is formed in a connection portion between the body 13 and the bottom portion 14 of the bottle. The bottom portion 14 of the bottle is formed in a cup shape and includes a tubular heel portion 17 in which an upper opening section is connected to a lower opening section of the body 13 and a bottom wall portion 19 which closes a lower opening section of the heel portion 17 and in which an outer circumferential edge is a grounding portion 18. In the heel portion 17, a fourth annular groove 31 is formed continuously over the entire circumference.

Figure 2:
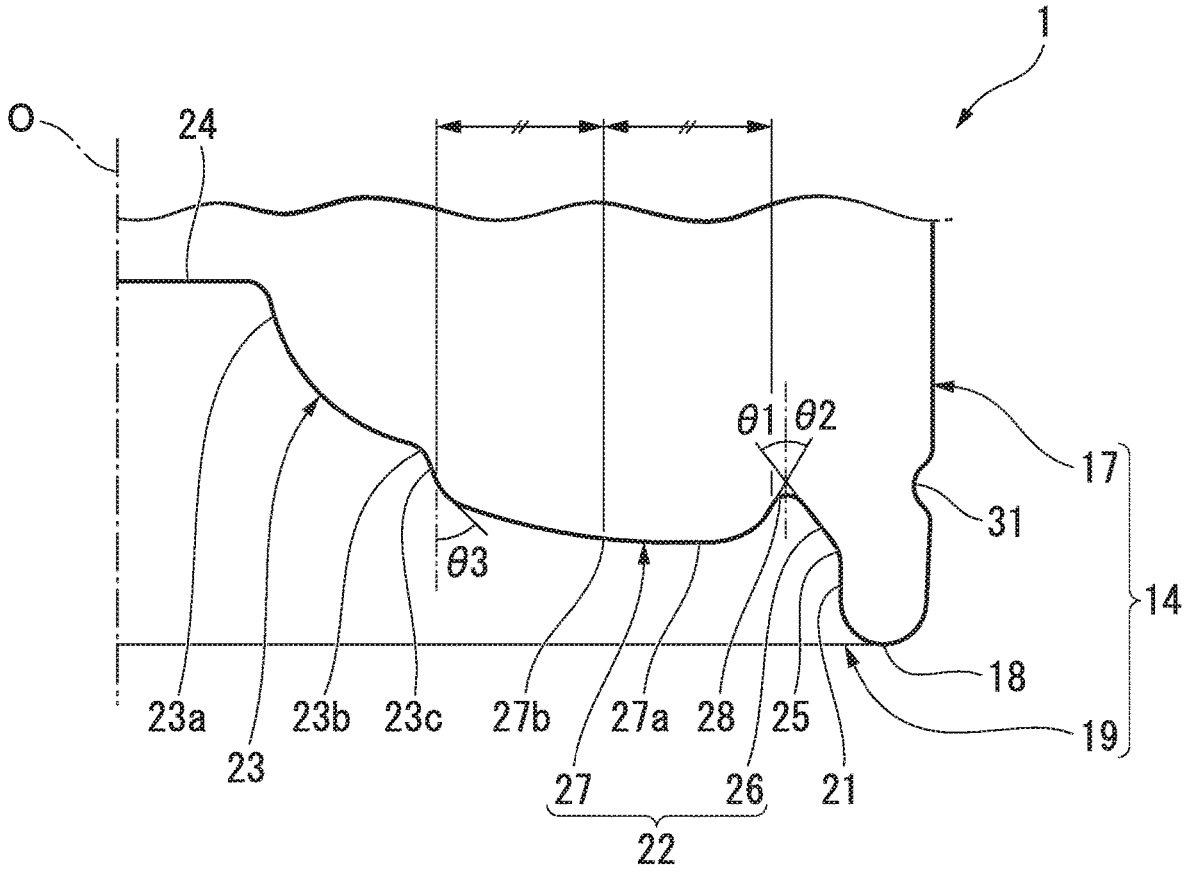
FIG. 2 is a half longitudinal cress-sectional view of a bottom portion of a pressure reduction-absorbing bottle shown in FIG. 1.

As shown in FIG. 2, the bottom wall portion 19 includes a rising circumferential wall portion 21 connected to the grounding portion 18 from an inner side of the bottle in the bottle radial direction and extending upward, an annular movable wall portion 22 extending from the upper end portion of the rising circumferential wall portion 21 toward the inner side of the bottle in the bottle radial direction, and a central wall portion 23 connected to an inner end portion of the movable wall portion 22 in the bottle radial direction.

The rising circumferential wall portion 21 extends substantially in a straight line in the vertical direction. The rising circumferential wall portion 21 may extend parallel to the bottle axis O or may be inclined to 5° or less, preferably 2° or less with respect to the vertical direction such that the rising circumferential wall portion 21 gradually extends inward in the bottle radial direction from a lower side toward an upper side in consideration of releasability from a mold. In the shown example, an inclination angle of the rising circumferential wall portion 21 is, for example, about 1.5°. The central wall portion 23 extends upward from the inner end portion of the movable wall portion 22 in the bottle radial direction. The central wall portion 23 is arranged coaxially with the bottle axis O and is formed in a tubular shape whose diameter gradually increases from an upper side toward a lower side. A disc-shaped top wall 24 arranged coaxially with the bottle axis O is connected to the upper end portion of the central wall portion 23 and a cylindrical shape with a top is formed by the entire central wall portion 23 and top wall 24. The central wall portion 23 is formed in a circular shape in the horizontal cross-sectional view. The central wall portion 23 extends downward from an outer circumferential edge of the top wall 24 and includes an upper wall portion 23*a* formed in a curved surface shape protruding inward in the bottle radial direction, a lower wall portion 23*c* whose diameter gradually decreases upward from the inner end portion of the movable wall portion 22 in the bottle radial direction, and a bent part 23*b* which connects the lower end portion of the upper wall portion 23*a* and the upper end portion of the lower wall portion 23*c* and is formed in a concave curved surface shape recessed outward in the bottle radial direction.

The movable wall portion 22 is formed in an annular shape and arranged coaxially with the bottle axis O. An outer end portion of the movable wall portion 22 in the bottle radial direction is connected to the upper end portion of the rising circumferential wall portion 21 and the inner end portion of the movable wall portion 22 in the bottle radial direction is connected to an outer end portion of the central wall portion 23 in the bottle radial direction. The outer end portion of the movable wall portion 22 in the bottle radial direction and the upper end portion of the rising circumferential wall portion 21 are connected to each other via a first curved surface part 25 recessed outward in the bottle radial direction. The movable wall portion 22 is moved rotationally about a first curved surface part (connection portion between the movable wall portion 22 and the rising circumferential wall portion 21) 25 to move the central wall portion 23 in the vertical direction.

The outer end portion of the movable wall portion 22 in the bottle radial direction is an inclined portion 26 gradually extending upward from the upper end portion of the rising circumferential wall portion 21 toward the inner side of the bottle in the bottle radial direction. An inclination angle θ1 of the inclined portion 26 with respect to the vertical direction is greater than an inclination angle of the rising circumferential wall portion 21 with respect to the vertical direction. In a vertical cross-sectional view in the vertical direction, the length of the inclined portion 26 is equal to or slightly shorter than the length of the rising circumferential wall portion 21. Note that the present invention is not limited thereto, and in the vertical cross-sectional view in the vertical direction, the length of the inclined portion 26 may be equal to or longer than the length of the rising circumferential wall portion 21.

The movable wall portion 22 includes a curved portion 27 connected to the outer end portion of the central wall portion 23 in the bottle radial direction and having a curved surface shape protruding downward. The curved portion 27 is connected to the inclined portion 26 from an inner side of the inclined portion 26 in the bottle radial direction. That is, the movable wall portion 22 is composed of the curved portion 27 and the inclined portion 26. For example, a flat portion or the like may be arranged between the curved portion 27 and the inclined portion 26. An inclination angle θ2 of an outer end portion of the curved portion 27 in the bottle radial direction with respect to the vertical direction is equal to or slightly less than the inclination angle θ1 of the inclined portion 26 with respect to the vertical direction. Note that the present invention is not limited thereto and the inclination angle θ2 may be equal to or greater than the inclination angle θ1. When the outer end portion of the curved portion 27 in the bottle radial direction is a curved surface, the inclination angle θ2 is an inclination angle of a tangent circumscribing the curved surface with respect to the vertical direction in the vertical cross-sectional view in the vertical direction. An inclination angle θ3 of the inner end portion of the curved portion 27 in the bottle radial direction with respect to the vertical direction is greater than the inclination angle θ1. Note that the present invention is not limited thereto and the inclination angle θ3 may be equal to or less than the inclination angle θ1 or equal to or less than the inclination angle θ2. When the inner end portion of the curved portion 27 in the bottle radial direction is a curved surface, the inclination angle θ3 is an inclination angle of a tangent circumscribing the curved surface with respect to the vertical direction. The curved portion 27 and the inclined portion 26 are joined to each other via a second curved surface part (connection portion between the curved portion 27 and the inclined portion 26) 28 recessed upward.

In the vertical cross-sectional view in the vertical direction, a curvature radius of the first curved surface part 25 connecting the inclined portion 26 and the upper end portion of the rising circumferential wall portion 21 is greater than a curvature radius of the second curved surface part 28 connecting the curved portion 27 and the inclined portion 26. In other words, in the vertical cross-sectional view in the bottle axial direction, the curvature radius of the connection portion 25 between the inclined portion 26 and the upper end portion of the rising circumferential wall portion 21 is greater than a curvature radius of the connection portion 28 of the movable wall portion 22 between the curved portion 27 connected to the inclined portion 26 from the inner side of the inclined portion 26 in the bottle radial direction and the inclined portion 26. Note that the present invention is not limited thereto, and in the vertical cross-sectional view in the vertical direction, the curvature radius of the first curved surface part 25 may be equal to or smaller than the curvature radius of the second curved surface part 28. In the vertical cross-sectional view in the vertical direction, a length of the curved portion 27 is longer than the length of the inclined portion 26. In the shown example, a length of the curved portion 27 in the bottle radial direction is also longer than that of the inclined portion 26 in the bottle radial direction. In other words, in the vertical cross-sectional view in the bottle axial direction, the length of the curved portion 27 of the movable wall portion 22 connected to the inclined portion 26 from the inner side of the inclined portion 26 in the bottle radial direction and connected to the central wall portion 23 from the outer side of the central wall portion 23 in the bottle radial direction is longer than the length of the inclined portion 26. Note that the present invention is not limited thereto, and in the vertical cross-sectional view in the vertical direction, the length of the curved portion 27 may be equal to shorter than the length of the inclined portion 26 and the length of the curved portion 27 in the bottle radial direction may be equal to or shorter than the length of the inclined portion 26 in the bottle radial direction.

Also, in the embodiment, a lowest portion 27*a* of the curved portion 27 positioned at a lowest position is disposed at a portion of the curved portion 27 positioned further outward in the bottle radial direction than the central position 27*b* of the curved portion 27 in the bottle radial direction. The curved portion 27 gradually extends upward as it goes away from the lowest portion 27*a* in the bottle radial direction. The lowest portion 27*a* of the curved portion 27 is disposed at a position of the curved portion 27 positioned further outward in the bottle radial direction than the central position 27*b* of the curved portion 27 in the bottle radial direction in a state in which the pressure reduction-absorbing bottle 1 is empty before the pressure reduction-absorbing bottle 1 is filled with contents. Positions of the lowest portion 27*a* and the first curved surface part 25 in the vertical direction are equivalent to each other. In the vertical cross-sectional view in the vertical direction, a curvature radius of a portion of the curved portion 27 at which the lowest portion 27*a* is positioned is greater than the curvature radius of the first curved surface part 25. In the vertical cross-sectional view in the vertical direction, a curvature radius of a portion of the curved portion 27 positioned further inward in the bottle radial direction than the lowest portion 27*a* is greater than a curvature radius of a portion of the curved portion 27 positioned further outward in the bottle radial direction than the lowest portion 27*a*.

The lowest portion 27*a* is disposed at a portion of the curved portion 27 positioned further outward in the bottle radial direction than a central position 27*b* of the curved portion 27 in the bottle radial direction.

The pressure reduction-absorbing bottle 1 constituted as described above is filled with contents at a high temperature (for example, about 40° C. to 95° C.). At this time, the bottom wall portion 19 is deformed and the movable wall portion 22 is displaced downward. The pressure reduction-absorbing bottle 1 is sealed in this state so that the bottom wall portion 19 is deformed at the time of reducing a pressure in the pressure reduction-absorbing bottle 1 accompanying subsequent cooling and the movable wall portion 22 is displaced upward. Thus, the pressure reduction is absorbed.

As described above, according to the pressure reduction-absorbing bottle 1 in the embodiment, in the curved portion 27 connected to the outer end portion of the central wall portion 23 in the bottle radial direction, the lowest portion 27*a* is disposed at a portion of the curved portion 27 positioned further outward in the bottle radial direction than the central position 27*b* of the curved portion 27 in the bottle radial direction. For this reason, a long distance in the bottle radial direction between the lowest portion 27*a* and the outer end portion of the central wall portion 23 in the bottle radial direction is secured. Therefore, in conjunction with an increase in curvature radius of an inner peripheral portion of the curved portion 27 connected to the central wall portion 23, deformation of the lowest portion 27*a* of the curved portion 27 such that it points downward when the central wall portion 23 is displaced downward associated with filling of contents can be minimized and thus the movable wall portion 22 can be rotationally moved evenly upward over the entire circumference when a pressure in the bottle becomes negative after sealing is applied.

The central wall portion 23 extends upward from the inner end portion of the movable wall portion 22 in the bottle radial direction. For this reason, the inner end portion of the movable wall portion 22 in the bottle radial direction is easily deformed when the central wall portion 23 is displaced downward accompanying filling of the contents. As a result, the above-described effects can be effectively achieved.

As described above, according to the pressure reduction-absorbing bottle 1 in the embodiment, the inclined portion 26 is formed on the outer end portion of the movable wall portion 22 in the bottle radial direction. For this reason, the movable wall portion 22 is easily rotationally moved downward about the first curved surface part 25 connecting the upper end portion of the rising circumferential wall portion 21 and the inclined portion 26 at the time of filling of contents. Therefore, an amount of displacement toward the side below the movable wall portion 22 at the time of filling of the contents can be increased and a pressure-reduction absorbing capacity in a sealing state can be increased. Moreover, since the movable wall portion 22 is rotationally moved downward about the first curved surface part 25 which is spaced apart upward from the grounding portion 18 at the time of filling of the contents, deformation of the grounding portion 18 when the movable wall portion 22 is displaced downward can be prevented. As described above, a pressure-reduction absorbing capacity can be increased without decreasing ground-contact stability.

Also, in the vertical cross-sectional view in the vertical direction, the curvature radius of the first curved surface part 25 connecting the inclined portion 26 and the upper end portion of the rising circumferential wall portion 21 is greater than the curvature radius of the second curved surface part 28 connecting the inner part 27 and the inclined portion 26. For this reason, at the time of filling of the contents, the movable wall portion 22 can be easily rotationally moved downward about the first curved surface part 25. Furthermore, in the vertical cross-sectional view in the vertical direction, the length of the inner part 27 is longer than the length of the inclined portion 26. For this reason, the movable wall portion 22 can be rotationally moved downward about the first curved surface part 25 while deformation of the inclined portion 26 is minimized at the time of filling of the contents. Therefore, an amount of displacement toward the lower side of the movable wall portion 22 at the time of filling of the contents can be effectively increased.

Note that the technical scope of the present invention is not limited to the above-described embodiment and various modifications can be provided without departing from the gist of the present invention.

Figure 3:
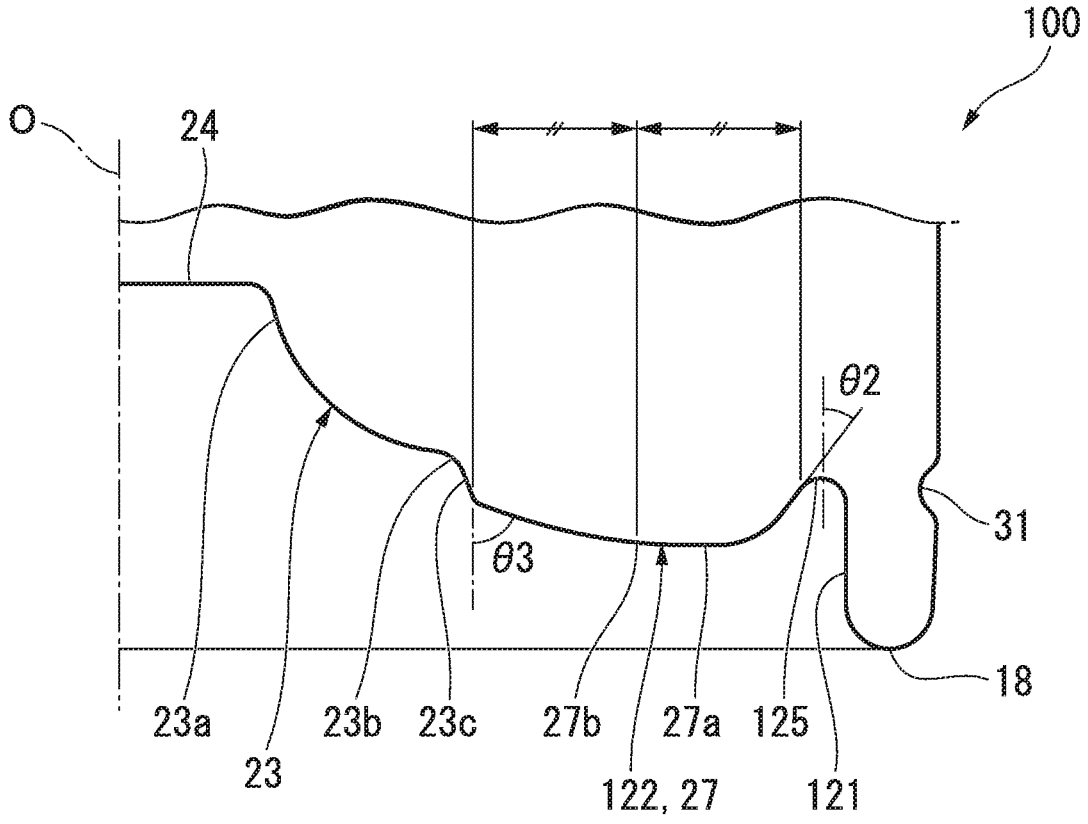
FIG. 3 is a half longitudinal cress-sectional view of a bottom portion of a pressure reduction-absorbing bottle shown in a variation according to the present invention.
Figure 4:
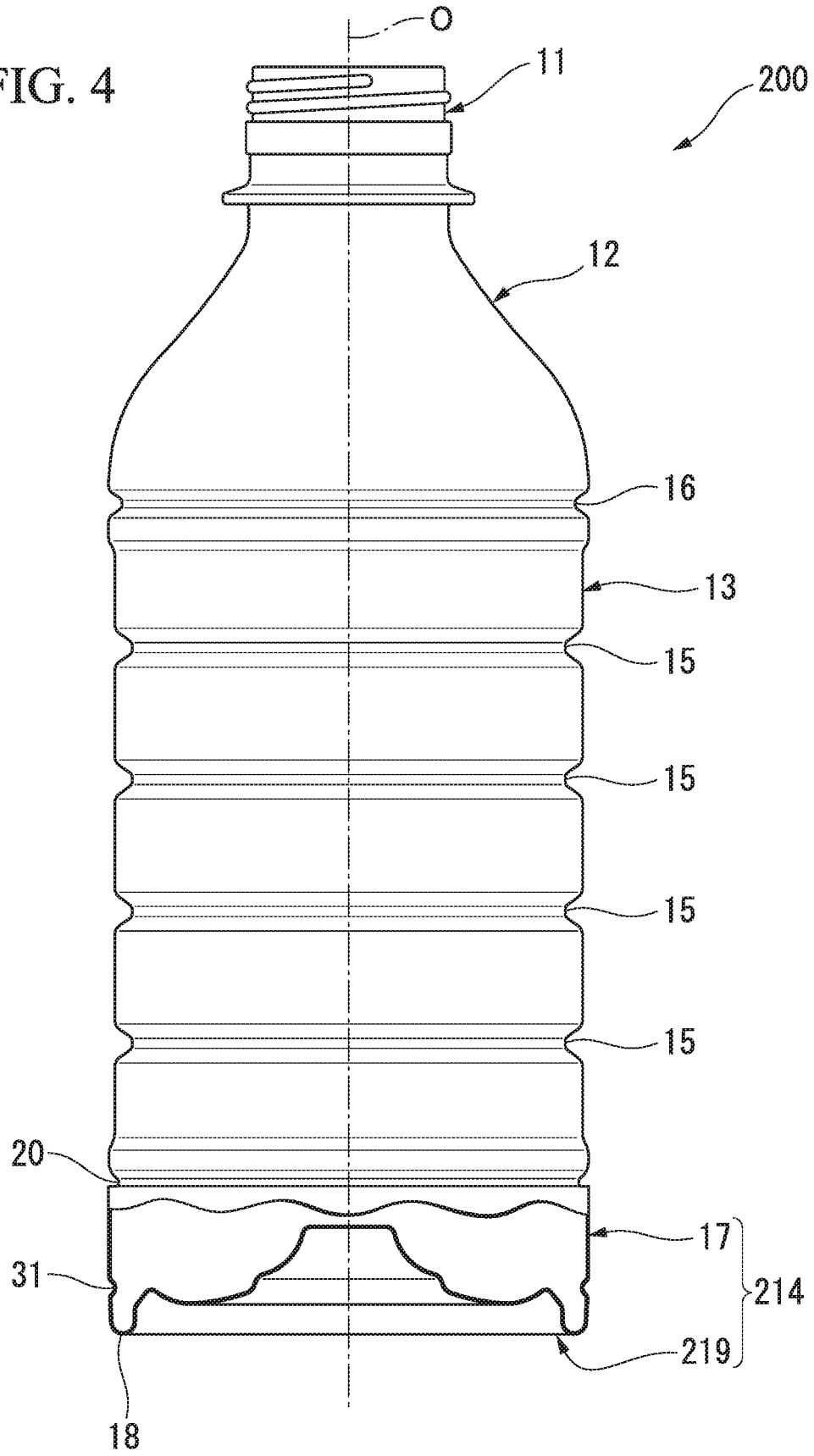
FIG. 4 is a partial cross-sectional view of a pressure reduction-absorbing bottle shown in a variation according to the present invention.
Figure 5:
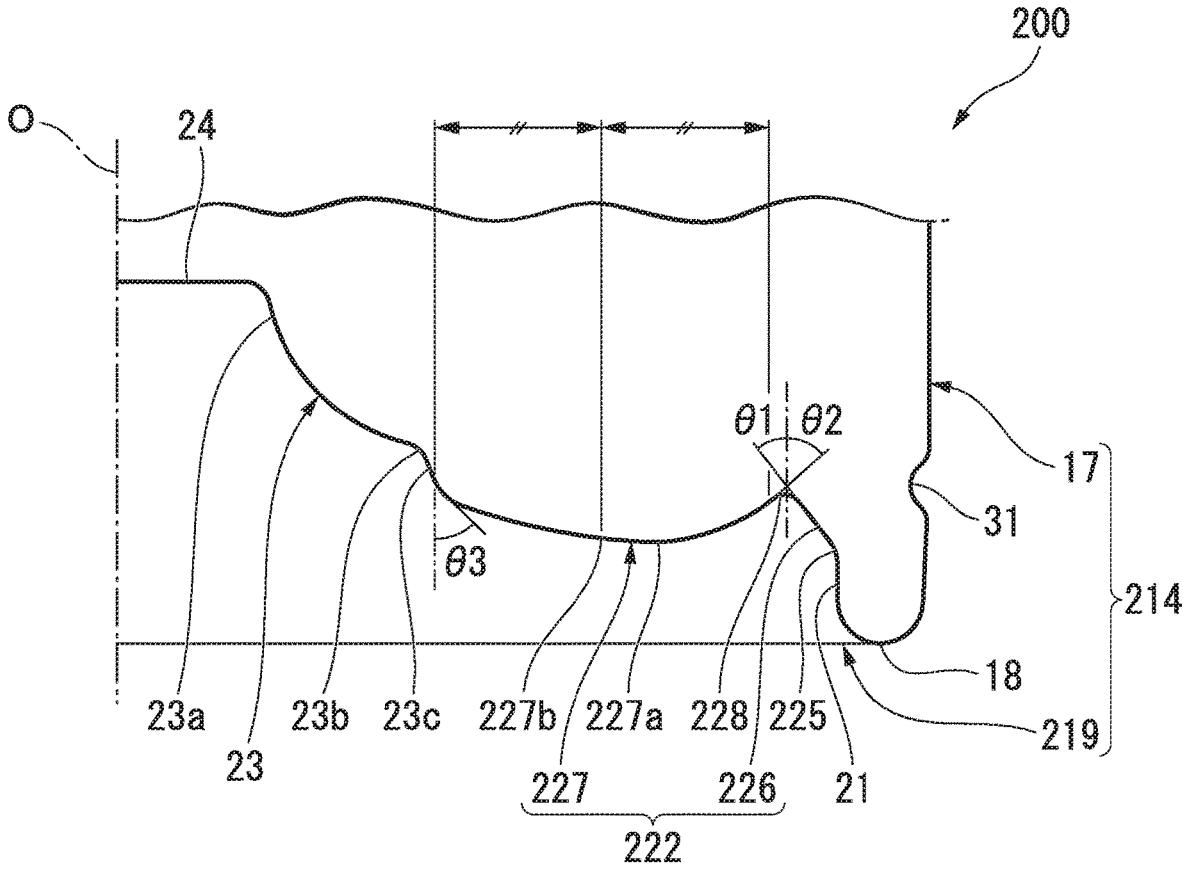
FIG. 5 is a half longitudinal cress-sectional view of a bottom portion of the pressure reduction-absorbing bottle shown in FIG. 4.

For example, the central wall portion 23 is not limited to the above-described embodiment and appropriate modifications such as extending in a straight line in the vertical direction, forming in a flat plate shape, or the like may be performed. For example, as shown in FIG. 3, the pressure reduction-absorbing bottle 100 in which a movable wall portion 122 includes only the curved portion 27 without the inclined portion 26 and the second curved surface part 28 and the first curved surface part 125 connecting the movable wall portion 122 and a rising circumferential wall portion 121 is recessed upward may be adopted. For example, as shown in FIG. 4 and FIG. 5, the inclination angle θ2 may be greater than the inclination angle θ1 (detailed explanation is provided in a variation discussed below). Furthermore, as the bottom wall portion 19, for example, a constitution in which the entire part which does not have the central wall portion 23 and is further inward in the bottle radial direction than the rising circumferential wall portion 221 is formed of the movable wall portion, a constitution in which a flat wall portion orthogonal to the bottle axis O is connected to the inner end portion of the movable wall portion 22 in the bottle radial direction, or the like may be adopted. Furthermore, as the bottom wall portion 19, a constitution in which the top wall 24 is not provided may be adopted. For example, polyethylene terephthalate, polyethylene naphthalate, amorphous polyester, or the like or materials which are mixtures of these or the like may be appropriately changed as a synthetic resin material for forming the pressure reduction-absorbing bottle 1, 100. In addition, the pressure reduction-absorbing bottle 1, 100 is not limited to a single-layer structure and may have a laminated structure with an intermediate layer. Examples of the intermediate layer include a layer made of a resin material having a gas barrier property, a layer made of recycled materials, a layer made of a resin material having oxygen absorbability, and the like. Although the shape of the mouth portion 11, the shoulder 12, the body 13, and the bottom portion 14 of the bottle in the horizontal cross-sectional view orthogonal to the bottle axis O is a circular shape in the above-embodiment, the present invention is not limited thereto. The shapes of the mouth portion 11, the shoulder 12, the body 13, and the bottom portion 14 of the bottle in the horizontal cross-sectional view may be appropriately changed to, for example, an angular shape or the like.

Besides, the constituent elements in the above-described embodiment can be appropriately replaced with well-known constituent elements without departing from the gist of the present invention and the above-described modified examples may be appropriately combined.

(Variation)

A pressure reduction-absorbing bottle according to a variation of the present invention will be described below with reference to FIG. 4 and FIG. 5. The bottle 200 of the variation has a bottom wall portion 214 shown in FIG. 4 and FIG. 5 instead of the bottle wall portion 14 of the bottle of the above-referenced embodiment. In addition, in the pressure reduction-absorbing bottle 200 of the variation, the same reference numerals are given to the same components as those of the bottle of the above-referenced embodiment.

As shown in FIG. 4, the bottom portion 214 of the bottle is formed in a cup shape and includes a tubular heel portion 17 whose upper opening section is connected to a lower opening section of the body 13 and a bottom wall portion 219 which closes a lower opening section of the heel portion 17 and whose outer circumferential edge is a grounding portion 18.

As shown in FIG. 5, the bottom wall portion 219 includes a rising circumferential wall portion 21 connected to the grounding portion 18 from an inner side of the bottle in the bottle radial direction and extending upward, a movable wall portion 222 extending from the upper end portion of the rising circumferential wall portion 21 toward the inner side of the bottle in the bottle radial direction, and a central wall portion 23 extending upward from an inner end portion of the movable wall portion 222 in the bottle radial direction.

The movable wall portion 222 is formed in an annular shape and arranged coaxially with the bottle axis O. An outer end portion of the movable wall portion 222 in the bottle radial direction is connected to an upper end portion of the rising circumferential wall portion 221 and an inner end portion of the movable wall portion 222 in the bottle radial direction is connected to a lower end portion of the central wall portion 23. The outer end portion of the movable wall portion 222 in the bottle radial direction and the upper end portion of the rising circumferential wall portion 221 are connected to each other via the first curved surface part 225 recessed outward in the bottle radial direction. The movable wall portion 222 is freely rotationally moved about the first curved surface part (connection portion between the movable wall portion 222 and the rising circumferential wall portion 21) 225 such that the central wall portion 23 is moved in the vertical direction.

Also, in the embodiment, the outer end portion of the movable wall portion 222 in the bottle radial direction is an inclined portion 226 gradually extending upward from the upper end portion of the rising circumferential wall portion 21 toward the inner side of the bottle in the bottle radial direction. An inclination angle θ1 of the inclined portion 226 with respect to the vertical direction is greater than an inclination angle of the rising circumferential wall portion 21 with respect to the vertical direction. In the vertical cross-sectional view in the vertical direction, a length of the inclined portion 226 is equal to or slightly shorter than a length of the rising circumferential wall portion 221. Note that the present invention is not limited thereto, and in the vertical cross-sectional view in the vertical direction, the length of the inclined portion 226 may be equal to or longer than the length of the rising circumferential wall portion 221.

In the movable wall portion 222, an curved portion 227 connected to the inclined portion 226 from the inner side of the inclined portion 226 in the bottle radial direction and connected to the central wall portion 23 from an outer side of the central wall portion 23 in the bottle radial direction is formed in a curved surface shape protruding downward and gradually extends downward from the outer side of the central wall portion 23 in the bottle radial direction toward the inner side of the bottle. That is, the movable wall portion 222 is composed of the curved portion 227 and the inclined portion 226. An inner end portion of the curved portion 227 in the bottle radial direction is connected to the lower end portion of the central wall portion 23. An inclination angle θ2 of the curved portion 227 in the bottle radial direction with respect to the vertical direction is greater than the inclination angle θ1 of the inclined portion 226 with respect to the vertical direction. The curved portion 227 and the inclined portion 226 are joined to each other via a second curved surface part 228 recessed upward.

In the vertical cross-sectional view in the vertical direction, a curvature radius of the first curved surface part 225 connecting the inclined portion 226 and the upper end portion of the rising circumferential wall portion 21 is greater than a curvature radius of the second curved surface part 228 connecting the curved portion 227 and the inclined portion 226. Note that the present invention is not limited thereto, and in the vertical cross-sectional view in the vertical direction, the curvature radius of the first curved surface part 225 may be equal to or smaller than the curvature radius of the second curved surface part 228. Furthermore, in the vertical cross-sectional view in the vertical direction, a length of the curved portion 227 is longer than the length of the inclined portion 226. In the shown example, a length of the curved portion 227 in the bottle radial direction is also longer than that of the inclined portion 226 in the bottle radial direction. Note that the present invention is not limited thereto, and in the vertical cross-sectional view in the vertical direction, the length of the curved portion 227 may be equal to or shorter than the length of the inclined portion 226 and the length of the curved portion 227 in the bottle radial direction may be equal to or shorter than the length of the inclined portion 226 in the bottle radial direction.

A lowest portion 227*a* of the curved portion 227 positioned at a lowest position thereof is disposed at a portion of the curved portion 227 positioned further outward in the bottle radial direction than the central position 227*b* of the curved portion 227 in the bottle radial direction. The curved portion 227 gradually extends upward as it goes away from the lowest portion 227*a* in the bottle radial direction. The lowest portion 227*a* of the curved portion 227 is disposed at a position of the curved portion 227 positioned further outward in the bottle radial direction than the central position 227*b* of the curved portion 227 in the bottle radial direction 200 in a state in which the pressure reduction-absorbing bottle 200 is empty before the pressure reduction-absorbing bottle 200 is filled with contents. Positions of the lowest portion 227*a* and the first curved surface part 225 in the vertical direction are equivalent to each other. In the vertical cross-sectional view in the vertical direction, a curvature radius of a portion of the curved portion 227 at which the lowest portion 227*a* is positioned is greater than the curvature radius of the first curved surface part 225. In the vertical cross-sectional view in the vertical direction, a curvature radius of a portion of the curved portion 227 positioned further inward in the bottle radial direction than the lowest portion 227*a* is greater than a curvature radius of a portion of the curved portion 227 positioned further outward in the bottle radial direction than the lowest portion 227*a*.

The lowest portion 227*a* is disposed at a portion of the curved portion 227 positioned further outward in the bottle radial direction than a central position 227*b* of the curved portion 227 in the bottle radial direction.

The pressure reduction-absorbing bottle 200 constituted as described above is filled with contents at a high temperature (for example, about 40° C. to 95° C.), and at this time, the bottom wall portion 219 is deformed and the movable wall portion 222 is displaced downward. Sealing is performed in this state so that the bottom wall portion 219 is deformed at the time of reducing a pressure in the pressure reduction-absorbing bottle 200 accompanying subsequent cooling and the movable wall portion 222 is displaced upward. Thus, the pressure reduction is absorbed.

As described above, according to the pressure reduction-absorbing bottle 1 in the embodiment, the inclined portion 226 is formed on the outer end portion of the movable wall portion 222 in the bottle radial direction. For this reason, the movable wall portion 222 is easily rotationally moved downward about the first curved surface part 225 connecting the upper end portion of the rising circumferential wall portion 221 and the inclined portion 226 at the time of filling of contents. Therefore, an amount of displacement toward the side below the movable wall portion 222 at the time of filling of the contents can be increased and a pressure-reduction absorbing capacity in a sealing state can be increased. Moreover, since the movable wall portion 222 is rotationally moved downward about the first curved surface part 225 which is spaced apart upward from the grounding portion 18 at the time of filling of the contents, deformation of the grounding portion 18 when the movable wall portion 222 is displaced downward can be prevented. As described above, a pressure-reduction absorbing capacity can be increased without decreasing ground-contact stability.

Also, in the vertical cross-sectional view in the vertical direction, the curvature radius of the first curved surface part 225 connecting the inclined portion 226 and the upper end portion of the rising circumferential wall portion 221 is greater than the curvature radius of the second curved surface part 228 connecting the curved portion 227 and the inclined portion 226. For this reason, at the time of filling of the contents, the movable wall portion 222 can be easily rotationally moved downward about the first curved surface part 225. Furthermore, in the vertical cross-sectional view in the vertical direction, the length of the curved portion 227 is longer than the length of the inclined portion 226. For this reason, the movable wall portion 222 can be rotationally moved downward about the first curved surface part 225 while deformation of the inclined portion 226 is minimized at the time of filling of the contents. Therefore, an amount of displacement toward the lower side of the movable wall portion 222 at the time of filling of the contents can be effectively increased.

(Verification Test)

A verification test of the above-described action effects will be described below.

Figure 6:
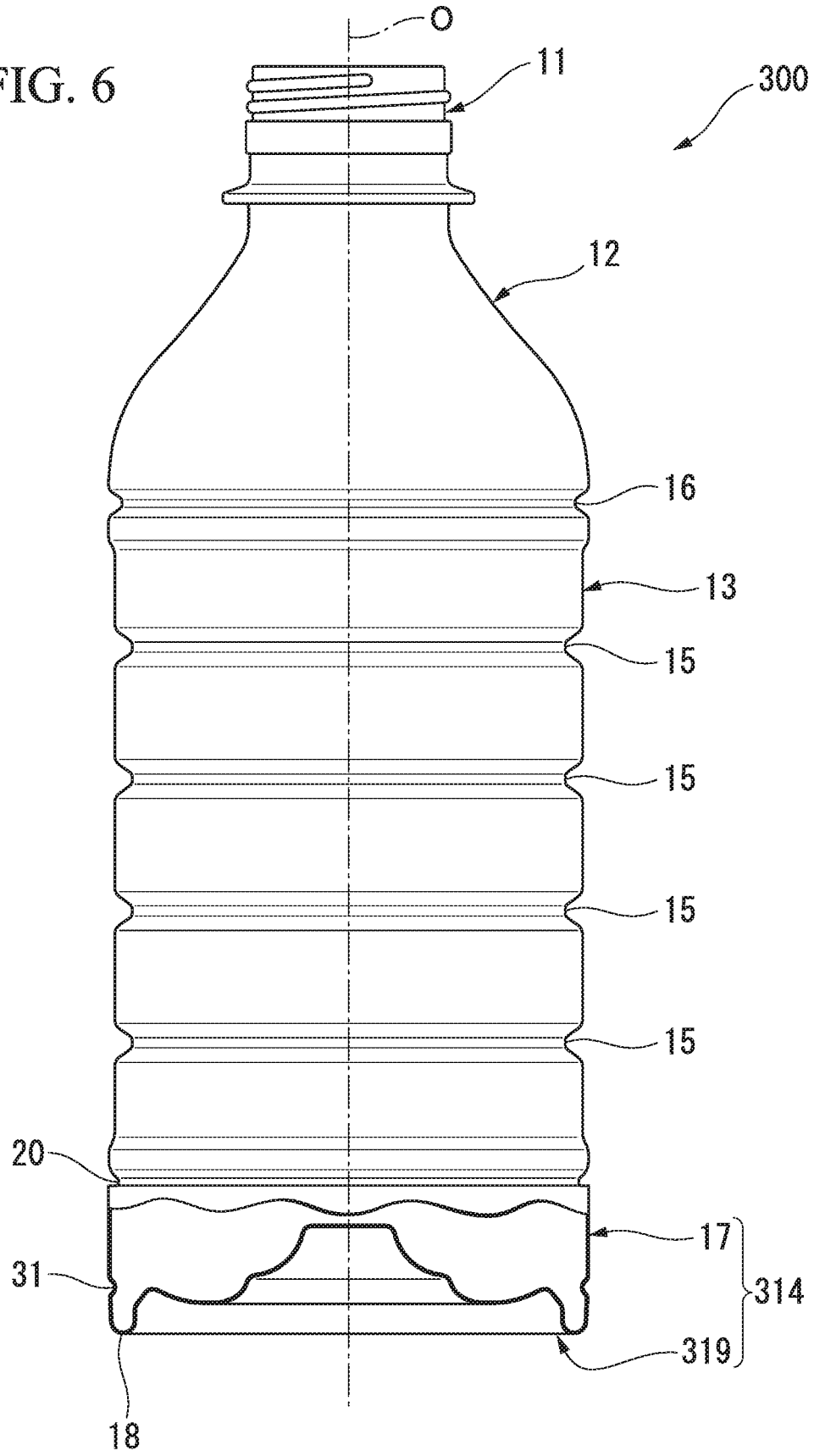
FIG. 6 is a partial cross-sectional view of a pressure reduction-absorbing bottle shown in a reference example according to the present invention.
Figure 7:
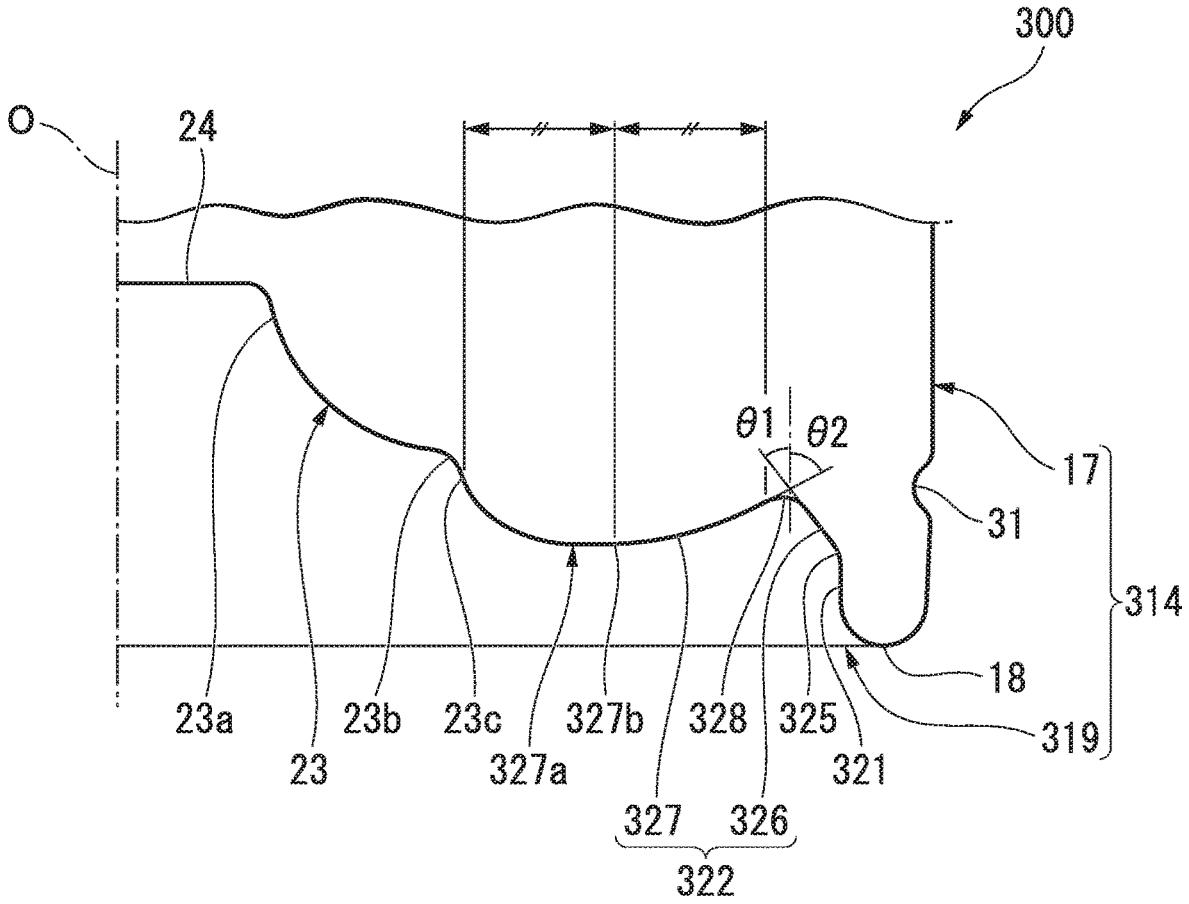
FIG. 7 is a half longitudinal cress-sectional view of a bottom portion of the pressure reduction-absorbing bottle shown in FIG. 6.
Figure 8:
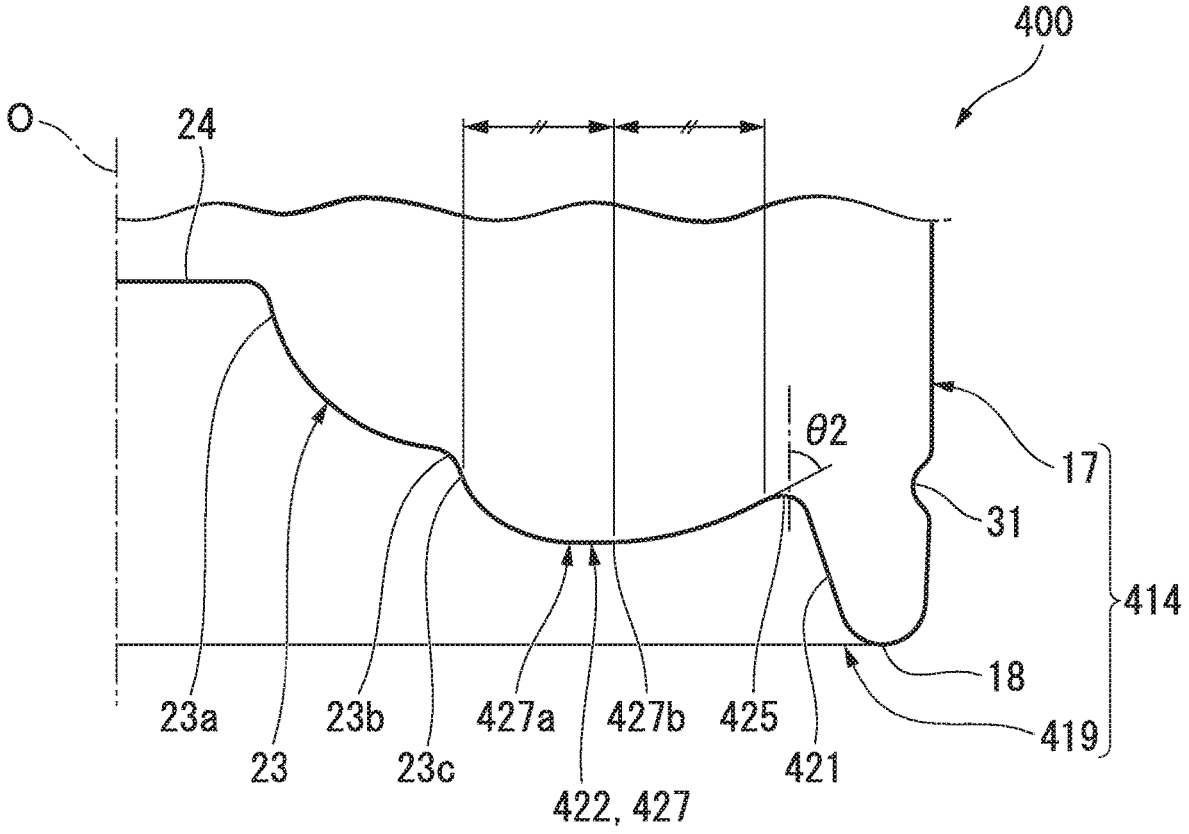
FIG. 8 is a half longitudinal cress-sectional view of a bottom portion of a pressure reduction-absorbing bottle shown in a comparative example according to the present invention.

As a reference example of the present invention, the pressure reduction-absorbing bottle 300 shown in FIG. 6 and FIG. 7 is adopted, and as a comparative example, a pressure reduction-absorbing bottle 400 shown in FIG. 8 is adopted. In the pressure reduction-absorbing bottle 300 in the reference example, a movable wall portion 322 of the bottom wall portion 319 of the bottom portion 314 has the inclined portion 226. In the pressure reduction-absorbing bottle 400 in the comparative example, a movable wall portion 422 of the bottom wall portion 419 of the bottom portion 414 does not have the inclined portion 326 and the rising circumferential wall portion 421 gradually extends inward in the bottle radial direction as it goes upward. An inclination angle of the rising circumferential wall portion 421 with respect to the vertical direction in the comparative example is greater than that of the rising circumferential wall portion 321 in the reference example. An inclination angle of the rising circumferential wall portion 321 in the comparative example is 19° and an inclination angle of the rising circumferential wall portion 321 in the example is 1.5°. The inclination angle θ1 of the inclined portion 326 in the example is 38°. In the vertical cross-sectional view in the vertical direction, a length of the rising circumferential wall portion 421 in the comparative example is about twice the length of the rising circumferential wall portion 321 in the reference example. The curved portion 327 in the example and a curved portion 427 in the comparative example have the same size and the same shape as each other. The first curved surface part 325 in the reference example is further outward in the bottle radial direction than the rising circumferential wall portion 421 in the comparative example. In the pressure reduction-absorbing bottle 400 in the comparative example, an outer end portion of the movable wall portion 422 in the bottle radial direction and an upper end portion of the rising circumferential wall portion 421 are connected to each other via a third curved surface part 425 recessed upward. In the vertical cross-sectional view in the vertical direction, a curvature radius of the third curved surface part 425 in the comparative example is smaller than the curvature radius of the second curved surface part 328 in the reference example. A position of the third curved surface part 425 in the bottle radial direction and a position thereof in the vertical direction with respect to a grounding portion 18 in the comparative example and a position of the second curved surface part 328 in the bottle radial direction and a position thereof in the vertical direction with respect to the grounding portion 18 in the reference example are coincident with each other.

Also, displacement of a bottom wall portion 319 when an internal pressure of 20 kPa was applied to the bottle 300 in the reference example was analyzed, and displacement of a bottom wall portion 419 when an internal pressure of 20 kPa was applied to the bottle 400 in the comparative example was analyzed. As a result, it was confirmed that an amount of displacement in the lowest displaced portion of the bottom wall portion 319 in the reference example was 6% greater than an amount of displacement in the lowest displaced portion of the bottom wall portion 419 in the comparative example. Furthermore, it was confirmed that the movable wall portion 322 is rotationally moved downward about the first curved surface part 325 in the pressure reduction-absorbing bottle 300 in the reference example, whereas the rising circumferential wall portion 421 is rotationally moved downward about a connection portion between the rising circumferential wall portion 421 and the grounding portion 18 in the pressure reduction-absorbing bottle 400 in the comparative example. In addition, the pressure reduction-absorbing bottle 300 of the reference example and the pressure reduction-absorbing bottle 400 of the comparative example are a bottle in which the lowest portion 327*a*, 427*a* of the curved portion 327, 427 positioned at the lowest position thereof is located at the portion of the curved portion 327, 427 further inward in the bottle radial direction than the central position 327*b*, 427*b* of the curved portion 327, 427 in the bottle radial direction. However, even in a bottle in which a lowest portion of a curved portion positioned at a lowest position thereof is located at a portion of the curved portion equal to a central position of the curved portion in a bottle radial direction or at a portion of the curved portion positioned further outward in the bottle radial direction than the central position, it is suggested that an amount of displacement in a lowest displaced portion of a bottom wall portion of a bottle provided with an inclined portion is greater than an amount of displacement in the lowest displaced portion of the bottom wall portion of a bottle provided without the inclined portion.

Note that the technical scope of the present invention is not limited to the above-described embodiments and various modifications can be provided without departing from the gist of the present invention.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A pressure reduction-absorbing bottle having a cylindrical shape with a bottom and formed of a synthetic resin material, the bottle comprising:

a bottom wall portion in a bottom portion of the bottle including:

a grounding portion positioned at an outer circumferential edge of the bottom wall portion;

a rising circumferential wall portion connected to the grounding portion from an inner side of the bottle in a bottle radial direction and extending upward;

an annular movable wall portion extending from an upper end portion of the rising circumferential wall portion toward the inner side of the bottle in the bottle radial direction; and a central wall portion connected to an inner end portion of the movable wall portion in the bottle radial direction, wherein the movable wall portion is arranged to be configured to be freely rotationally moved about a connection portion between the movable wall portion and the rising circumferential wall portion in a vertical direction together with the central wall portion and the movable wall portion includes a curved portion having a curved surface shape protruding downward, the curved portion is connected to an outer end portion of the central wall portion in the bottle radial direction, and a lowest portion of the curved portion positioned at a lowest position thereof is disposed at a portion of the curved portion positioned further outward in the bottle radial direction than a central position of the curved portion positioned at a center between outer and inner ends of the curved portion in the bottle radial direction.

2. The pressure reduction-absorbing bottle according to claim 1, wherein the central wall portion extends upward from the inner end portion of the movable wall portion in the bottle radial direction.

3. The pressure reduction-absorbing bottle according to claim 2, wherein an outer end portion of the movable wall portion in the bottle radial direction is an inclined portion gradually extending upward as it goes from the upper end portion of the rising circumferential wall portion toward the inner side of the bottle in the bottle radial direction.

4. The pressure reduction-absorbing bottle according to claim 1, wherein an outer end portion of the movable wall portion in the bottle radial direction is an inclined portion gradually extending upward as it goes from the upper end portion of the rising circumferential wall portion toward the inner side of the bottle in the bottle radial direction.

5. The pressure reduction-absorbing bottle according to claim 4, wherein, in a vertical cross-sectional view in a bottle axial direction, a curvature radius of a connection portion between the inclined portion and the upper end portion of the rising circumferential wall portion is greater than a curvature radius of a connection portion of the movable wall portion between the inclined portion and the curved portion connected to the inclined portion from an inner side of the inclined portion in the bottle radial direction.

6. The pressure reduction-absorbing bottle according to claim 4, wherein, in a vertical cross-sectional view in a bottle axial direction, a length of the curved portion of the movable wall portion connected to the inclined portion from an inner side of the inclined portion in the bottle radial direction and connected to the central wall portion from an outer side of the central wall portion in the bottle radial direction is greater than a length of the inclined portion.

7. The pressure reduction-absorbing bottle according to claim 5, wherein, in the vertical cross-sectional view in the bottle axial direction, a length of the curved portion of the movable wall portion connected to the inclined portion from an inner side of the inclined portion in the bottle radial direction and connected to the central wall portion from an outer side of the central wall portion in the bottle radial direction is greater than a length of the inclined portion.

* * * * *